US005719548A

United States Patent [19]

Stirling et al.

[11] Patent Number: 5,719,548

[45] Date of Patent: Feb. 17, 1998

[54] BOWLING SCORING CONSOLE

[75] Inventors: Michael F. Stirling, Spring Lake, Mich.; Daniel E. Gremonprez, Westbend, Wis.

[73] Assignee: Brunswick Bowling & Billiards Corporation, Muskegon, Mich.

[21] Appl. No.: 369,801

[22] Filed: Jan. 9, 1995

[51] Int. Cl.[6] ..... G08B 23/00; A63D 5/04

[52] U.S. Cl. ..... 340/323 B; 340/323 R; 364/410; 364/411; 473/54; 473/67; 473/70; 361/682; 361/683; 348/825; 348/826; 348/836

[58] Field of Search ..... 340/323 B, 323 R; 364/410, 411; 473/54, 65, 67, 70; 361/680–683, 686; 312/194–196, 7.2; 348/825, 826, 836, 838; 11/11

[56] References Cited

U.S. PATENT DOCUMENTS 3,252,705 5/1966 Cornberg ..... 340/323 B
4,517,512 5/1985 Petrich et al. ..... 361/415
4,824,109 4/1989 Cervantes ..... 340/323 B
5,021,763 6/1991 Obear ..... 348/373
5,255,185 10/1993 Mowers et al. ..... 340/323 R

*Primary Examiner*—Donnie L. Crosland
*Attorney, Agent, or Firm*—Price, Heneveld, Cooper, DeWitt & Litton

[57] ABSTRACT

A scoring system for a bowling center having a plurality of lanes includes scoring consoles equal in number to the number of lanes in the bowling center. Each scoring console includes a housing and an input system in the housing for receiving user input data related to the associated lane. The console includes a display device having a surface for displaying video images and a housing for the display device. The housing supports the display device and includes a flange surrounding an open area defining a quadrilateral opening in the housing for viewing the display surface. The display device attaches to the mounting portion. In this manner, the mounting assembly draws the flange toward the display surface to conform the flange to the three-dimensional surface configuration of the display surface.

16 Claims, 6 Drawing Sheets

BOWLING SCORING CONSOLE

BACKGROUND OF THE INVENTION

This invention relates generally to bowling automatic scoring systems and, more particularly, to a scoring console for controlling the scoring system. More particularly, the invention relates to a unique scoring console structure, as well as an arrangement of scoring consoles, in a bowling scoring system.

Automatic scoring systems for bowling centers have been provided which respond to an output produced by a pin-fall monitor in order to automatically score each bowler's game. The automatic scoring system typically includes a scoring console having a display device and a user input for displaying video information, including scores, and for entering the names of bowlers, correcting scoring errors, and the like. One such system is disclosed in commonly owned U.S. Pat. No. 5,255,185 for a BOWLING CENTER VIDEO DISPLAY SYSTEM, the disclosure of which is hereby incorporated herein by reference.

Scoring consoles for bowling scoring systems are conventionally organized around a pair of bowling lanes. Such console includes one or more display devices for displaying bowling scores for both lanes in the associated pair of lanes, as well as one or more input devices for receiving user input selections related to both lanes in the pair of lanes. The basis for such organization of the scoring console is believed to be a natural evolution of the manual scoring system in which a single scoring table and associated seating was provided for each pair of lanes. In such manual scoring system, the scoring was conducted by the bowlers and, therefore, was necessarily closely tied with the bowler's portion of the lane pair in order to provide a short distance between the scoring area and the bail return for each of the pair of lanes.

In commonly assigned U.S. Pat. No. 5,618,238, issued by Apr. 8, 1997, to Richard A. Kruse et al., for a BOWLING SCORING SYSTEM, the disclosure of which is hereby incorporated herein by reference, a bowling scoring console is disclosed which, in one embodiment, includes a touch-screen user input device. In such console, the user input selections are made by the user touching a portion of the display device, which selection is detected by the user input system. Such touch-screen input system may be incompatible with the protective transparent surface covering the CRT display in prior scoring consoles. By eliminating such protective surface, it is necessary to provide a liquid barrier between the front surface of the CRT display and the surrounding portion of the console housing in order to protect against inadvertent spills of beverages and the like on the CRT display, which is oriented in a partially horizontal plane. Such liquid barrier is difficult at best because of the three-dimensional curvature of conventional CRT display surfaces.

SUMMARY OF THE INVENTION

The present invention is intended to provide a bowling scoring system utilizing scoring consoles, which are structured and arranged in a manner which makes optimum use of the capabilities of the scoring system. The present invention further provides a bowling scoring console, which provides a liquid barrier between the display surface and the surrounding portion of the scoring console housing.

A bowling scoring system for a bowling center having a plurality of bowling lanes, according to one aspect of the invention, includes a plurality of scoring consoles that are substantially equal in number to the number of lanes in the bowling centers. One of the scoring consoles is combined with each of the lanes. Each of the scoring consoles includes at least a housing and an input system housed by the housing for receiving user input data related to the associated lane. The invention is based upon the realization that, because the scoring function is carried out automatically and does not require constant attention from the bowlers, the placement of the scoring console may be more optimally arranged by a bowling scoring console which is associated with only one lane. The invention facilitates exceptional flexibility in layout of bowlers' areas in bowling centers and increases ease of use of the scoring system by facilitating a separate input device for each lane.

A bowling scoring console, according to another aspect of the invention, includes a display device having a display surface for displaying video images and a housing for the display device. The housing includes a mounting portion for mounting the display device. The mounting portion includes a flange surrounding an open area defining a quadrilateral opening in the housing for viewing the display surface. The mounting portion is made from a resinous plastic material. A mounting assembly is provided for mounting the display device to the mounting portion and attaches to the mounting portion. In this manner, the mounting assembly draws the flange toward the display surface to conform the flange to the three-dimensional surface configuration of the display surface. This facilitates a liquid barrier between the housing and the display surface, which may be perfected by the imposition of a gasket positioned between the flange and the display surface. In a preferred embodiment, the scoring console display is made up of a pair of housing sections which are made substantially entirely from resinous plastic material and including a metal chassis member in the housing for providing mounting surfaces for mounting electronic circuit boards.

These and other objects, advantages, and features of this invention will become apparent upon review of the following specification in conjunction with the drawings.

DESCRIPTION OF THE PREFERRED EMBODIMENT

Figure 1:
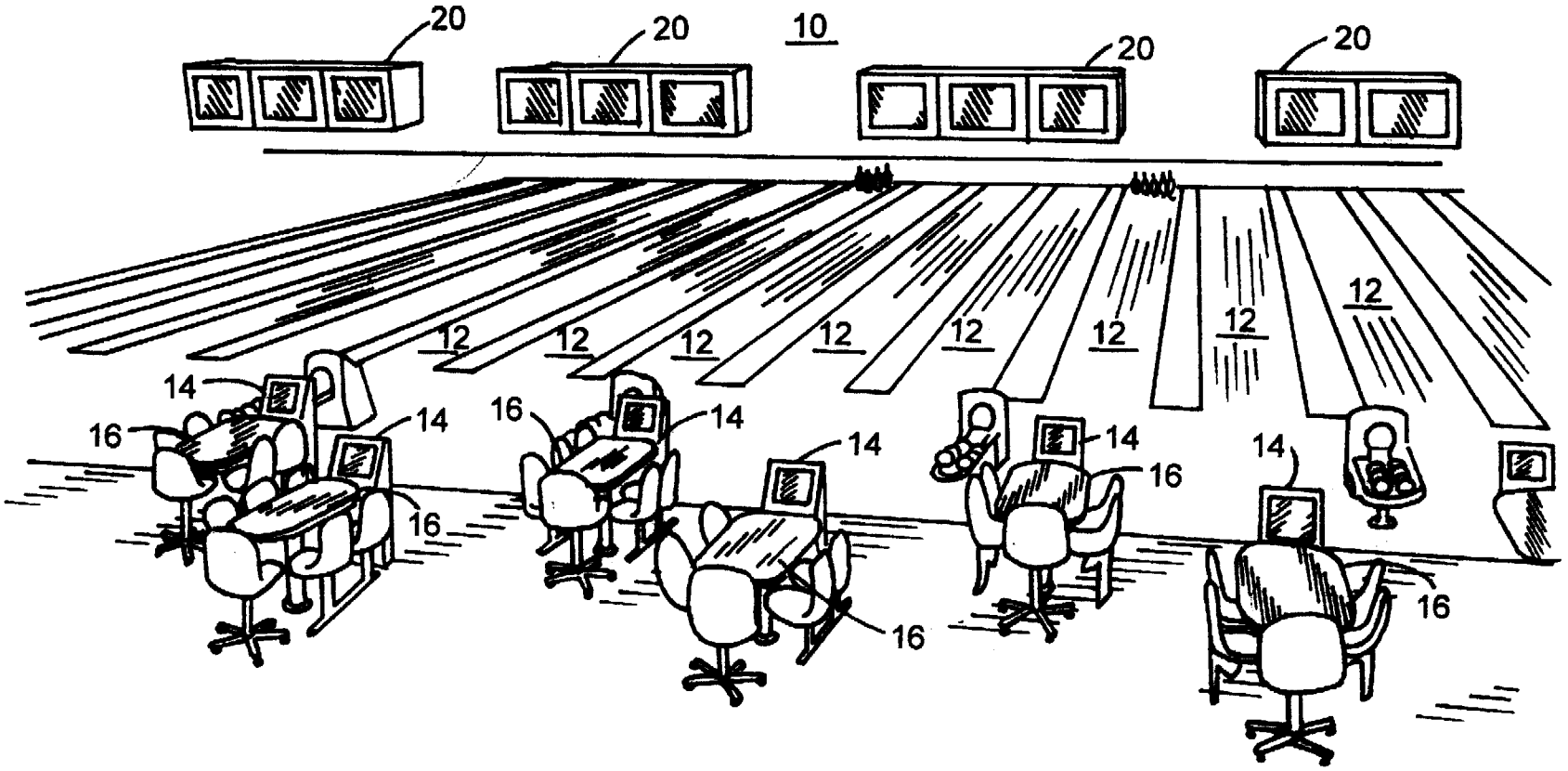
FIG. 1 is a perspective view of a bowling center incorporating a bowling scoring system, according to the invention.

Referring now specifically to the drawings, and the illustrative embodiments depicted therein, a bowling center illustrated in FIG. 1 includes a bowling scoring system, generally referred to at 10, for providing automatic scoring of bowling games at a plurality of bowling lanes 12. Bowling scoring system 10 includes a pin-fall monitor (not shown) for sensing the pins knocked down at each lane 12 and one or more manager consoles (not shown) for providing overall control of bowling scoring system 10. Scoring system 10 further includes a plurality of bowling scoring consoles 14 which, according to the invention, equal in number substantially the number of lanes 12 in the bowling center. The consoles and lanes are associated with one bowling scoring console 14 with each lane 12. A scoring processor, which receives input from bowling scoring console 14 and the pin-fall detection unit and computes the scores for each lane, may be positioned within bowling scoring console 14 or may be a separate assembly located in the vicinity of the pinsetter associated with each lane 12 or elsewhere in the bowling center.

Figure 2:
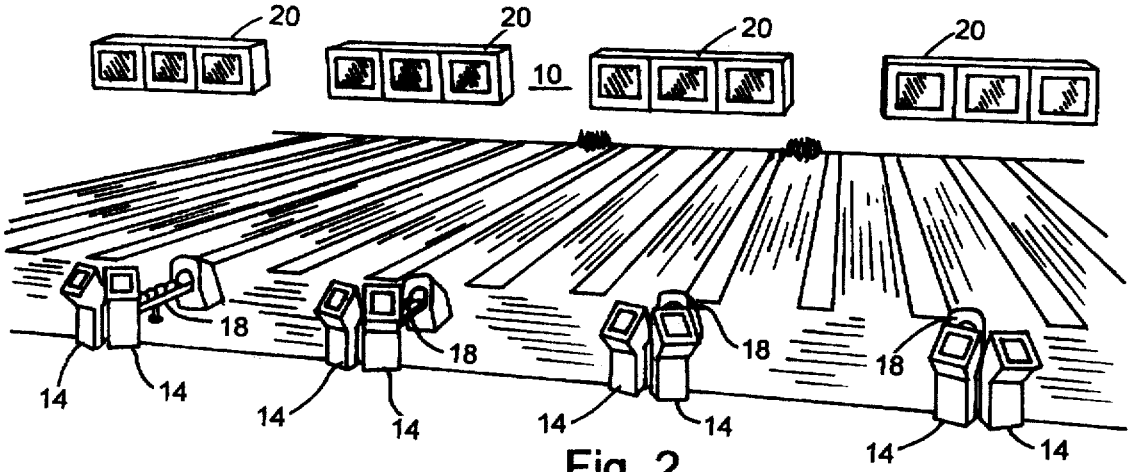
FIG. 2 is the same view as FIG. 1 illustrating the bowling scoring consoles of the scoring system advantageously positioned in locations different from those in FIG. 1.
Figure 5:
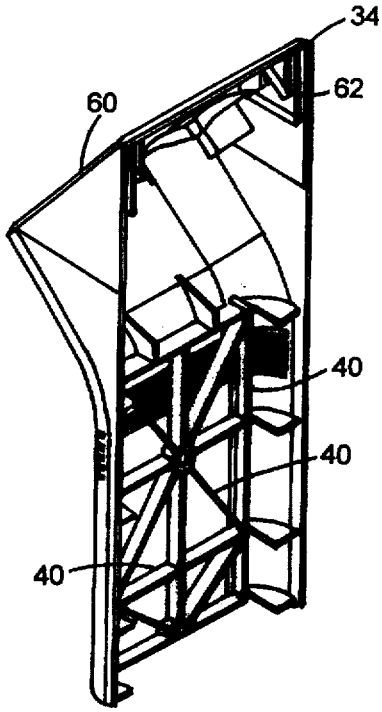
FIG. 5 is a perspective view taken generally from the rear of a front housing section.
Figure 6:
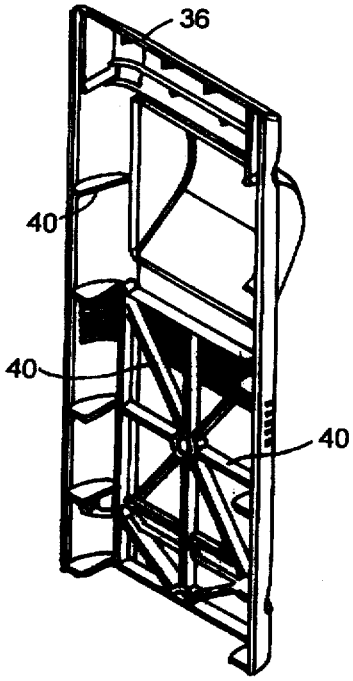
FIG. 6 is a perspective view taken generally from the front of a rear housing section.

As can be seen by comparing the physical layout of bowling scoring system 10 in FIGS. 1 and 2, bowling scoring console 14 may be conveniently positioned adjacent a table 16 associated with an individual lane 12. Alternatively, as illustrated in FIG. 2, bowling scoring consoles 14 could be positioned adjacent a ball return 18, which is used in common with a pair of lanes. However, the physical layout of bowling scoring system 10 is not limited to that illustrated in FIGS. 1 and 2. For example, it is customary in particular cultures to assign a lane supervisor for one or more lanes to supervise the entry of bowlers' names into the bowling scoring system in order to expedite changeover of lane users. For such applications, bowling scoring console 14 may be positioned more remote from lanes 12 for convenient use by the lane supervisor. In such configuration, the bowlers would view the scores on overhead monitors 20.

Figure 3:
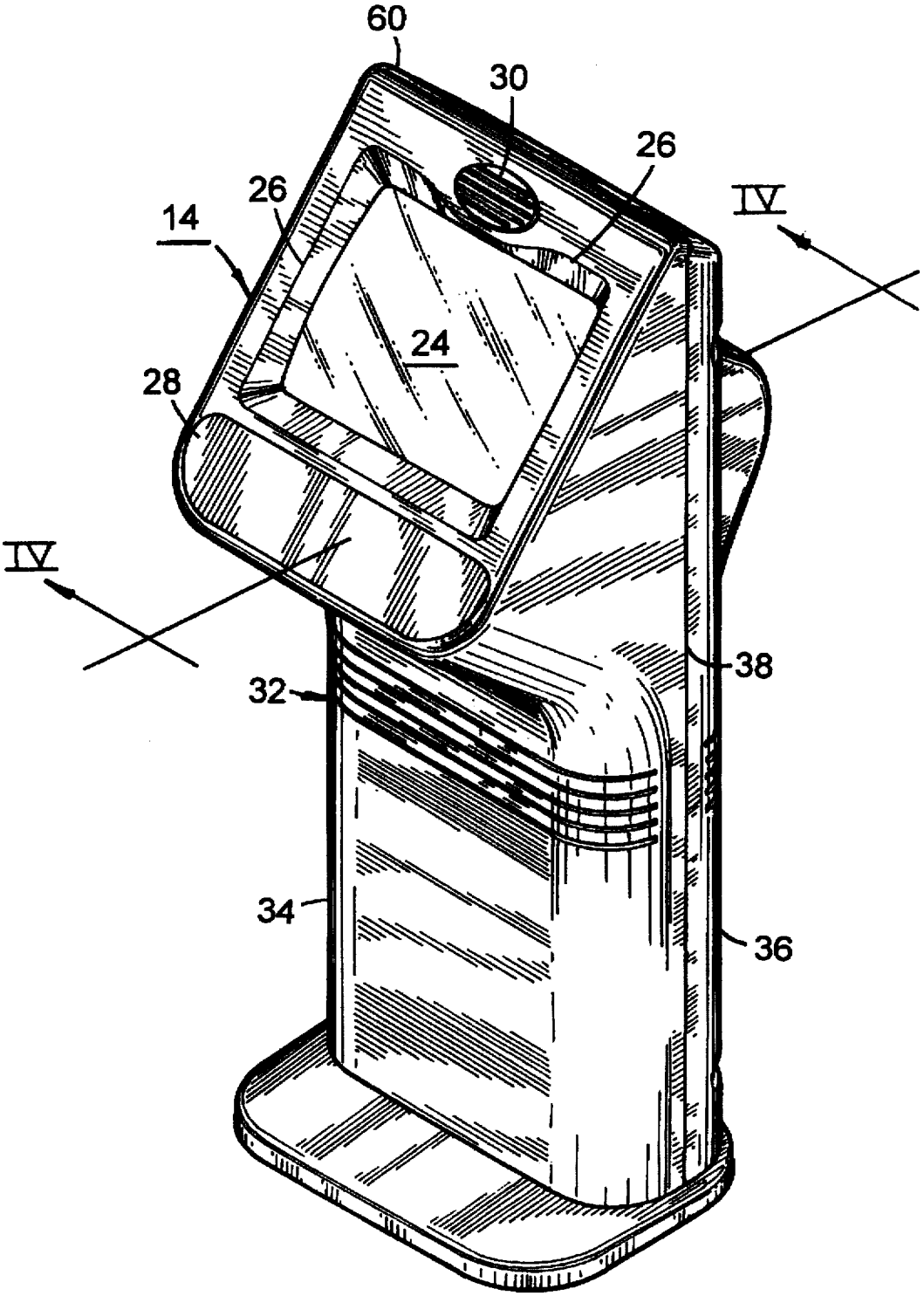
FIG. 3 is a perspective view taken generally from the front of a bowling scoring console, according to the invention.

Each bowling scoring console 14 includes a display device, generally illustrated at 22, positioned within a housing 32 and having a display surface 24, which is surrounded by a flange 26. In the illustrated embodiment, bowling scoring system 10 is capable of displaying indicia on display surface 24 and for recognizing user touch of a particular portion of display surface 24. Such an input system, known as a "touch screen," eliminates the necessity for a separate mechanical keyboard input device. Alternatively, a mechanical keyboard may be positioned in an area 28 directly below display surface 24. Bowling scoring console 14 additionally includes a speaker 30 for providing audio information to the user. As best seen by reference to FIGS. 3 and 4, display surface 24 is curved in three dimensions providing a complex surface for mating with flange 26. As is also apparent from the figures, display surface 24 is oriented somewhere between a plane position and a horizontal plane. Therefore, any liquid spilled on display surface 24 will seek the interface between the display surface and flange 26. This interface is provided with a liquid seal, as will be described in more detail below.

Figure 8:
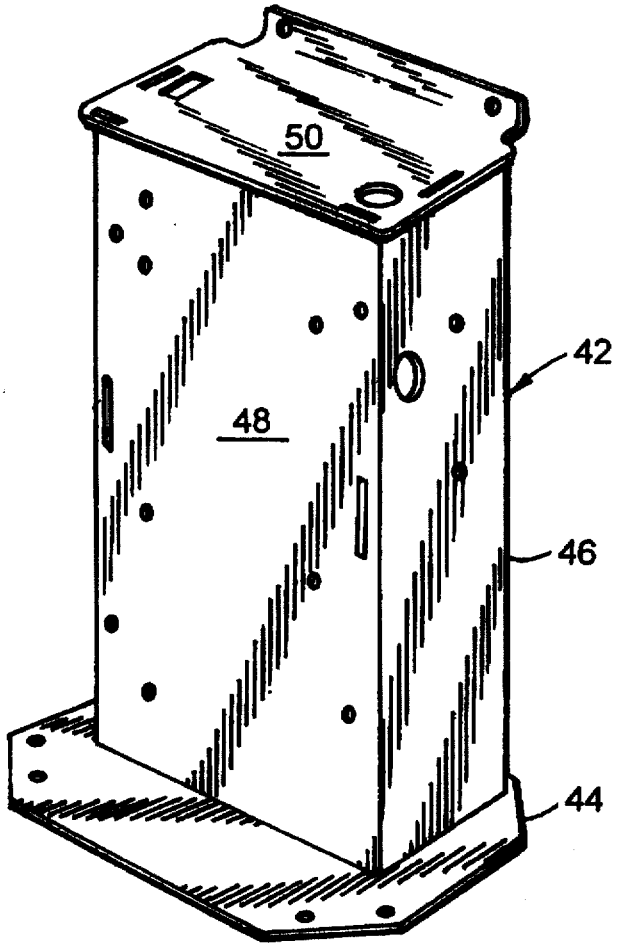
FIG. 8 is a perspective view of a metal console chassis.
Figure 9:
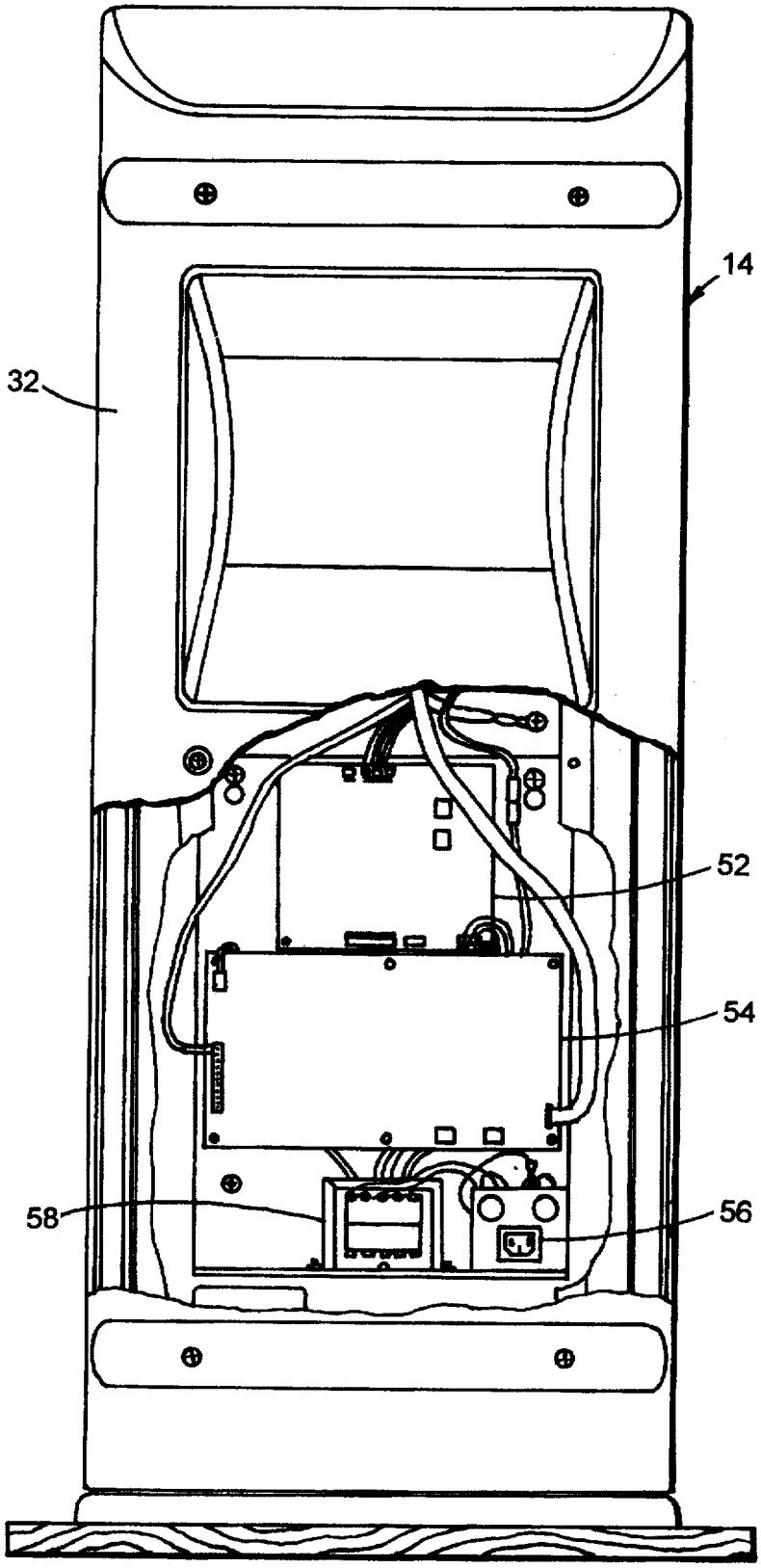
FIG. 9 is an elevation of a bowling scoring console taken from the rear with a portion of the housing removed in order to illustrate internal organization of the console.

Housing 32 is made up of a forward housing portion 34 and a rearward housing portion 36 mated together at a seam 38. Each of the forward and rearward housing portions are made up of a resinous plastic material, which is molded in a fashion that includes a network of reinforcing ribs 40 which provide structure integrity to the respective housing portion. In the illustrated embodiment, the forward and rearward housing portions are made from a structural foam, which is available commercially from numerous sources. Each of the housing portions 34, 36 are fastened to a metal chassis 42 (FIG. 8). Metal chassis 42 includes a base member 44 and an upstanding box member 46. Box member 46 includes a vertical surface 48 and a horizontal surface 50, which provide mounting surfaces for mounting electronic circuit boards 52, 54 and other circuit components, such as input connection terminal 56 and power transformer 58 (FIG. 9). Additionally, chassis 42 provides a structural member in order to add to the structural integrity of housing 32.

Figure 4:
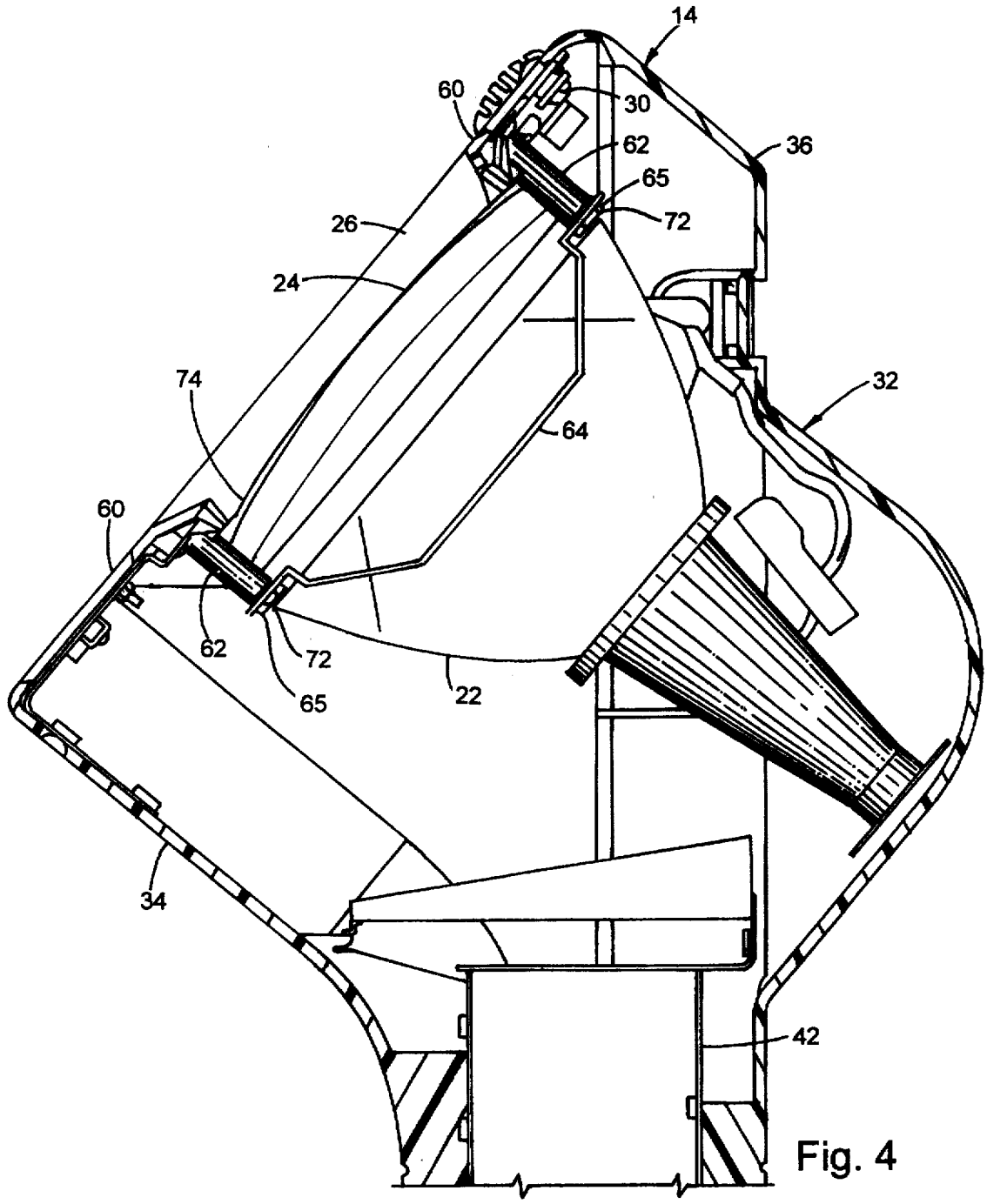
FIG. 4 is a sectional view taken along the lines IV—IV in FIG. 3.
Figure 7:
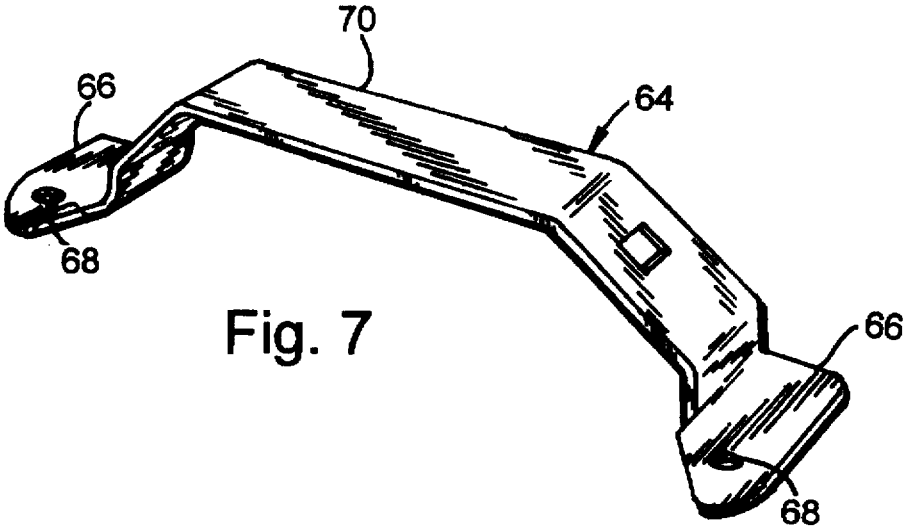
FIG. 7 is a perspective view of a display mounting bracket.

Housing 32 includes a mounting portion 60, which defines flange 26. Mounting portion 60 further includes four mounting studs 62 positioned at the comers of flange 26 within housing 32, as best illustrated in FIG. 4. A symmetrical pair of elongated brackets 64 are provided to provide an additional mounting point for fastening of an upper portion of rear housing section 36 (FIG. 7). Each bracket 64 includes a flange 66 on opposite ends thereof with a mounting hole 68 through each flange 66. Bracket 64 includes a raised central portion 70, which is configured to the contour of the rear envelope of display device 22. With a bracket 64 positioned on each lateral side of display device 22, fasteners 72 pass through openings 68 and threadably engage a mounting stud 62. The fasteners also pass through a mounting frame 65, which surrounds a portion of display device 22 behind display surface 24. Mounting frame 65 and fasteners 72 mount the display device to studs 62.

The components are dimensioned so that the tightening of fasteners 72 will initially draw the display surface 24 of display device 22 against flange 26, as best illustrated in FIG. 4. However, because flange 26 does not completely conform to the three-dimensional curvature of display surface 24, a gap will exist between the display surface and flange 26 in the corners thereof even after contact is made between flange 26 and display surface 24. However, further tightening of fasteners 72 will draw the comers of flange 26 into close proximity with display surface 24 by deforming flange 26 around the display surface. This provides a close fit between the flange and display surface. A gasket 74 is positioned between the display surface and flange to perfect a liquid-tight seal between the display surface and the flange when fasteners 72 are fully engaged with mounting studs 62.

In this manner, a liquid barrier is provided between display surface 24 and housing 32 of bowling scoring console 14 in order to resist the entry of liquids, such as spilled refreshments, from the interior of the scoring console. This is important because the partially horizontal orientation of display surface 24 increases the exposure of the interface between the display device and the housing to penetration by liquids. In this manner, bowling scoring console 14 may be protected against the entry of liquids without requiring a transparent shield over the display surface/housing interface. This facilitates flexibility in the configuration of a bowling scoring console by allowing direct user interface with the display surface. In this manner, various touch-screen input configurations may be utilized. For example, the invention may find application with touch-input devices which require direct user contact with the display surface. Alternatively, touch-screen input techniques, which utilize electro-optic sensor technology, may also be applied. The invention also allows aftermarket upgrade of a mechanical keyboard to a touch screen without requiring replacement of the entire console housing.

Changes and modifications in the specifically described embodiments can be carried out without departing from the principles of the invention, which is intended to be limited only by the scope of the appended claims, as interpreted according to the principles of patent law, including the doctrine of equivalents.

The embodiments of the invention in which an exclusive property or privilege is claimed are defined as follows:

1. A bowling scoring console, comprising:

a display device having a display surface for displaying video images; and a housing for said display device, said housing having a forward housing portion made from a resinous material supporting said display device, a rearward housing portion made from a resinous material mated with said forward housing portion and a chassis made from a metal between said housing portions, wherein said chassis extends upwardly in said housing to a location below said display device and wherein said display device is entirely supported by said forward housing.

2. The bowling scoring console in claim 1 including a flange defining a quadrilateral opening in said forward housing portion framing said display surface, mounting studs affixed to said forward housing portion at corners of said flange and a mounting frame surrounding portions of said display device and fastened to said mounting studs.

3. The bowling scoring console in claim 1 including a symmetrical pair of brackets for attaching a portion of said rearward housing portion.

4. The bowling scoring console in claim 2 wherein said forward housing portion, said mounting studs, and said mounting frame are configured to draw said flange to said display device when said mounting frame is fastened to said mounting studs.

5. A bowling scoring system for a bowling center having a plurality of bowling lanes, comprising:

a plurality of scoring consoles substantially equal in number to the number of lanes in the bowling center, one of said scoring consoles combined with each of said lanes, each of said scoring consoles including:

a free-standing housing defined by a base member, a support structure extending vertically upward from said base member, and a user-accessible surface provided at an angle to said support structure such that said user-accessible surface faces partially upward, and an input system housed by said housing and including input means for receiving user input data related to the associated lane, said input means being disposed on said user-accessible surface of said housing to allow user access regardless of whether the user is sitting or standing before the scoring console, each of said scoring consoles includes a display device housed by said housing for displaying bowling scores for the associated lane, wherein said housing includes a mounting portion for mounting said display device and a mounting assembly for joining said display device to said mounting portion, said mounting portion including a flange surrounding an open area defining a quadrilateral opening in said user-accessible surface of said housing for access to said display surface, wherein said mounting portion is made from a resinous plastic material and wherein said mounting assembly attaches to said mounting portion in order to draw said flange toward said display surface in order to conform said flange to the configuration of said display surface.

6. A bowling scoring system for a bowling center having a plurality of bowling lanes, comprising:

a plurality of scoring consoles substantially equal in number to the number of lanes in the bowling center, one of said scoring consoles combined with each of said lanes, each of said scoring consoles including:

a free-standing housing defined by a base member, a support structure extending vertically upward from said base member, and a user-accessible surface provided at an angle to said support structure such that said user-accessible surface faces partially upward, and an input system housed by said housing and including input means for receiving user input data related to the associated lane, said input means being disposed on said user-accessible surface of said housing to allow user access regardless of whether the user is sitting or standing before the scoring console, each of said scoring consoles includes a display device housed in said housing for displaying video images, said housing having a forward housing portion made from a resinous material supporting said display device, a rearward housing portion made from a resinous material mated with said forward housing portion and a chassis made from a metal between said housing portions, wherein said chassis extends upwardly in said housing to a location below said display device and wherein said display device is entirely supported by said forward housing portion.

7. A bowling scoring console, comprising:

a display device having a display surface for displaying video images;

a housing for said display device including a mounting portion for mounting said display device, said mounting portion including a flange surrounding an open area defining a quadrilateral opening in said housing for viewing said display surface, said mounting portion made from a resinous plastic material; and a mounting assembly for joining said display device to said mounting portion;

wherein said mounting assembly attaches to said mounting portion in order to draw said flange toward said display surface in order to conform said flange to the configuration of said display surface.

8. The bowling scoring console in claim 7 including a gasket positioned between said flange and said display surface to form a liquid barrier between said housing and said display surface.

9. The bowling scoring console in claim 7 wherein said mounting assembly includes a frame configured to surround a portion of said display device and wherein said mounting portion includes a stud at each corner of said open area for fastening said frame.

10. The bowling scoring console in claim 7 wherein said display surface has a configuration that is curved in three dimensions.

11. The bowling scoring console in claim 10 wherein said display device is a cathode ray tube.

12. The bowling scoring console in claim 7 wherein said housing includes a pair of housing sections made from resinous plastic material.

13. The bowling scoring console in claim 12 wherein said housing sections are each the full height of said housing and joined at a lateral seam.

14. The bowling scoring console in claim 13 including a chassis member in said housing, said chassis member made from metal.

15. The bowling scoring console in claim 14 wherein said chassis member includes mounting surfaces for mounting electronic circuit boards.

16. The bowling scoring console in claim 15 wherein said chassis member is vertically elongated and wherein said housing sections fasten to said chassis member.

* * * * *